US006140901A

United States Patent [19]

Muta et al.

[11] Patent Number: 6,140,901

[45] Date of Patent: Oct. 31, 2000

[54] COIL DEVICE

[75] Inventors: Junji Muta; Katsuya Ito, both of Yokkaichi, Japan

[73] Assignee: Sumitomo Wiring Systems, Ltd., Japan

[21] Appl. No.: 09/378,926

[22] Filed: Aug. 23, 1999

[30] Foreign Application Priority Data

Sep. 14, 1998 [JP] Japan ..... 10-259971

[51] Int. Cl.[7] ..... H01F 27/06; H01F 27/29

[52] U.S. Cl. ..... 336/65; 336/192; 439/823

[58] Field of Search ..... 336/65, 107, 192, 336/196, 200; 439/821, 823, 842, 865–868

[56] References Cited

U.S. PATENT DOCUMENTS 5,274,346 12/1993 Izu et al. ..... 333/184

FOREIGN PATENT DOCUMENTS 10-64618 3/1998 Japan .

*Primary Examiner*—Michael L. Gellner
*Assistant Examiner*—Tuyen Nguyen
*Attorney, Agent, or Firm*—Banner & Witcoff, Ltd.

[57] ABSTRACT

To produce a coil device in which fewer components are required, a plurality of coils 20 are attached to an attachment base 10, leading wires 24 of each coil 20 being attached to terminal fittings 30A and 30B of a connector member 13, and a feeder connector C being fitted with the connector member 13. Electricity is distributed to each coil 20 along a path of feeder electric wires W, the feeder connector C, the connector member 13, and leading wires 24. The leading wires 24 of the plurality of coils 20 are attached as a single unit to the single connector member 13. Since the feeder connector C is attached to this connector member 13, fewer components are required compared to the case in which each coil 20 is provided with an individual connector member.

10 Claims, 9 Drawing Sheets

COIL DEVICE

TECHNICAL FIELD

The present invention relates to a coil device.

As shown in FIG. 9 of this specification, the interior of a gearbox casing a of an automatic transmission of an automobile is provided with coil cases c, these coil cases c housing a plurality of coils b, which comprise solenoid devices for opening and closing hydraulic valves. An interrupted connector d is attached to the gearbox casing a in a manner so as to pass from the interior to the exterior thereof Within the gearbox casing a, an inner connector e is fitted to the interrupted connector d, a plurality of electric wires f branching off from this inner connector e, and a branch connector g being attached to each of these branched-off electric wires f. Each of these branch connectors g is fitted to a connector member h formed in each of the coil cases c. Further, a wire harness connector k is fitted to a fitting member j of the interrupted connector d, this fitting member j being on the exterior of the gearbox casing a. Electricity to each coil b is supplied along the path extending from the wire harness connector k to the interrupted connector d, the inner connector e, the electric wires f, the branch connectors g, and the connector member h.

In the above example, electricity is supplied to each coil b via the connector member h formed in the coil case c, this coil case c housing the coil b. The branch connector g is fitted to each connector member h. Consequently, every coil b requires a branch connector g, and the number of components thus becomes large. As a result, the cost thereof increases, and attachment operations and management are also cumbersome.

The present invention has been developed after taking the above problem into consideration, and aims to present a coil device in which fewer components are required.

SUMMARY OF THE INVENTION

According to the invention there is provided a connector base for a plurality of coils, the base having a plurality of attachment locations, one for each of a plurality of coils, and a connector body formed thereon, said connector body having a plurality of terminals housed therein and adapted to be connected to lead wires of the plurality of coils. Such an arrangement requires fewer individual connectors, and hence cost is reduced.

Preferably the base defines individual distribution paths for the lead wires of the coils, at least one path for each coil not crossing another. In this way electrical isolation is assured. The distribution paths may be defined by channels or walls, and the lead wires may be fixed therein by a filler such as epoxy resin. The coils may be located in recesses into which said paths extend.

Each terminal may be housed in a tubular body. Preferably these tubular bodies have a slot in the wall thereof through which a respective terminal reaches the interior. Each terminal may have a neck to locate in a respective slot.

The base is preferably covered by a cover which may be integrally moulded thereto after assembly of the coils to said base. Such a cover prevents interference from foreign objects and can avoid an individual cover for each coil.

BRIEF DESCRIPTION OF DRAWINGS

Other features of the invention will be apparent from the following description of preferred embodiments shown by way of example only in the accompanying drawings, in which.

DESCRIPTION OF PREFERRED EMBODIMENTS

An embodiment of the present invention is explained below with the aid of FIGS. 1 to 6.

Figure 9:
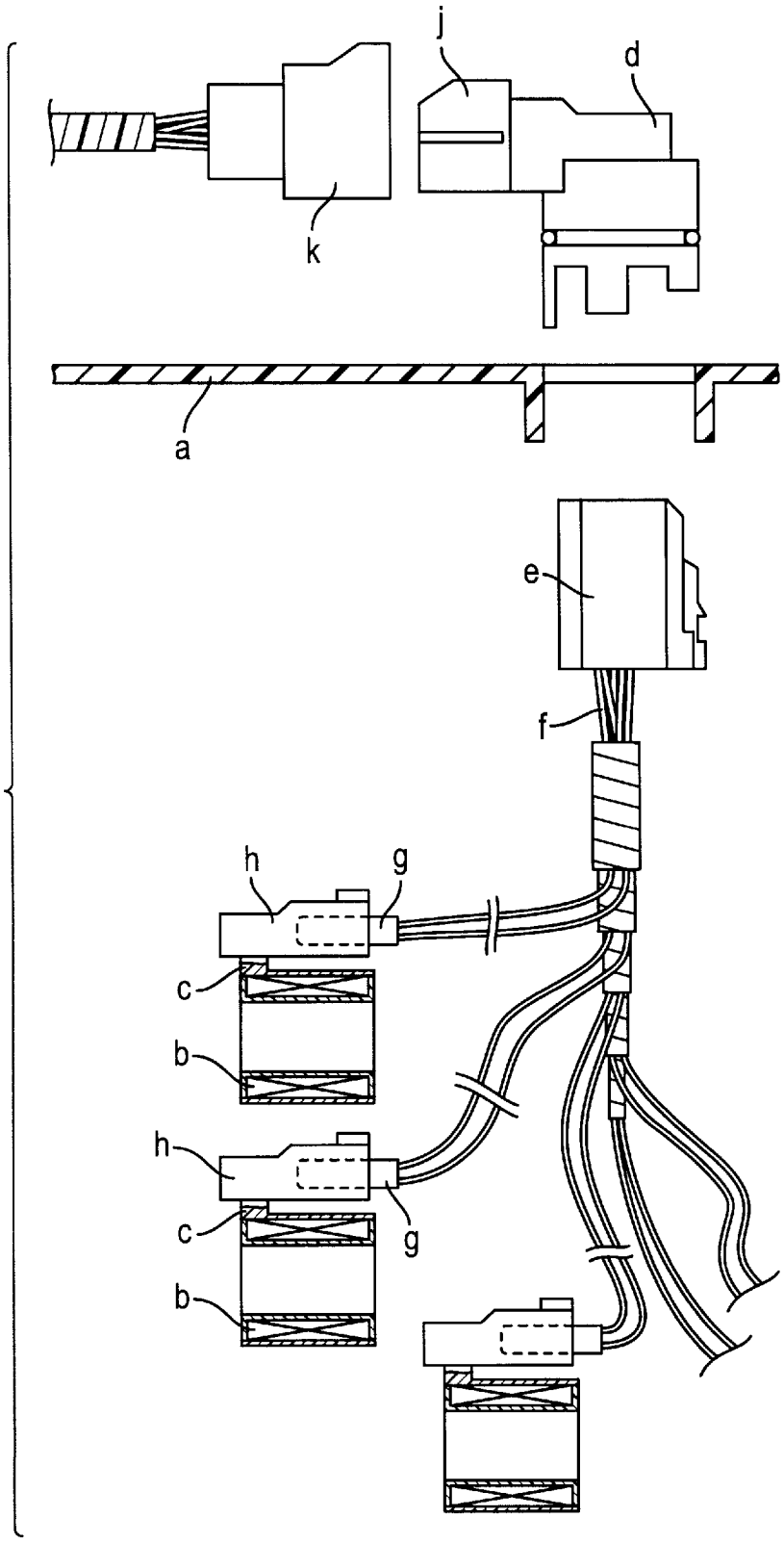
FIG. 9 (PRIOR ART)
FIG. 9 is a side face view of a prior art example.

Coil devices A of the present embodiment are provided within a gearbox casing of an automatic transmission of an automobile and form solenoid devices for opening and closing hydraulic valves. An interrupted connector is attached to the gearbox casing in a manner so as to pass from the interior to the exterior thereof An inner connector is fitted to a fitting ember of the interrupted connector within the gearbox casing, and a plurality of feeder electric wires W (six wires in the present embodiment) extend as a single bundle from the inner connector, the ends of these feeder electric wires W being attached to a feeder connector C. This feeder connector C fits with the coil device A of the present embodiment. An outer connector fits with a fitting member of the interrupted connector outside the gearbox casing, this outer connector being attached to a wire harness. Furthermore, the gearbox casing, the interrupted connector, the inner connector and the outer connector have the same configuration as those of the conventional example shown in FIG. 9.

Next, the coil device A of the present embodiment will be explained in detail. The coil device A is provided with an attachment base 10, a plurality of coils 20 (five in the present embodiment), a plurality of terminal fittings 30A and 30B (six in the present embodiment), and a cover. The attachment base 10 is, on the whole, flat and symmetrical. A total of five coil attachment members 11 are formed on the attachment base 10, three thereof being formed on a longer side of the attachment base 10, and two thereof being formed on a shorter side. Each coil attachment member 11 is circular and is formed in a concave fashion in a n upper face of the attachment base 10. The centre of each coil attachment member 11 has a circular through hole 12, and a lower end of the coil 20 is housed tightly therein. Each coil 20 comprises coiled strands of wire wound around the outer circumference of a bobbin 21, flanges 22 being provided on upper and lower ends thereof The lower flange 22 fits into the coil attachment member 11 and is fixed to the attachment base 10 by adhesive. In this fixed state, the core and diameter of the through hole 12 of the coil attachment member 11 matches that of a central hole 23 of the bobbin 21, and an armature (not shown) is inserted therethrough. This armature, together with the coil device A of the present embodiment, forms the solenoid device. Further, the two ends of the coiled strand of wire form two leading wires 24 which extend from the lower end of the coil 20.

A connector member 13 is formed on the upper face of the attachment base 10 at a location between the two coils 20 of the shorter side and the centrally located coil 20 of the longer side. The connector member 13 has six angular tubular shaped terminal supporting members 14 opening upwards from the attachment base 10, these terminal supporting members 14 supporting the terminal fittings 30A and 30B. The terminal supporting members 14 are aligned in two rows, each row having three terminal supporting members 14. These terminal supporting member 14 are grouped closely together. A vertical slit 14B is formed along the entire length, from top to bottom, of a side wall of each terminal supporting member 14, this slit connecting a housing space 14A to the external face.

The terminal fittings 30A and 30B are made from long and narrow metal strips, and comprise an upwardly protruding tab member 31, an electric wire attachment member 32 formed by bending the lower end of the tab member 31 diagonally upwards, and a narrow-width member 33 formed between the tab member 31 and the electric wire attachment member 32. The terminal fittings 30A and 30B are fixed by pressing the lower end of each tab member 31 into the housing space 14A of the terminal supporting member 14, the upper end of each tab member 31 protruding upwards from the terminal supporting member 14. When this pressing occurs, the narrow-width member 33 moves downwards along the slit 14B. Furthermore, when the terminal fittings 30A and 30B are in a pressed and fixed state, the electric wire attachment member 32 protrudes in a sideways direction from the lower end of the terminal supporting member 14. Among the six terminal fittings 30A and 30B which comprise the connector member 13, one terminal fitting 30A earths all of the coils 20. The remaining five terminal fittings 30B are attached individually to each of the coils 20.

Wire distribution grooves 15A and 15B are formed in a concave manner on the upper face of the attachment base 10, these wire distribution grooves 15A and 15B forming paths from the five coil attachment members 11 to the connector member 13. Five of these wire distribution grooves 15A and 15B are independent wire distribution grooves 15B which individually distribute one of the two leading wires 24 of each coil 20 to the connector member 13. The remaining wire distribution grooves are earthing wire distribution grooves 15A which distribute the other of the two leading wires 24 from each coil 20 to the connector member 13. The five independent wire distribution grooves 15B each lead, without mutually intersecting, to the connector member 13 and arrive at the five terminal supporting members 14 which support the terminal fittings 30B (the earthing terminal fitting 30A not being among those supported by the five terminal supporting members 14). The end of each leading wire 24 distributed along these independent wire distribution grooves 15B is wound around the electric wire attachment member 32 of each corresponding terminal fitting 30B, and is unified therewith by fusing, for example by ultrasonic welding. The earthing wire distribution grooves 15A also follow separate paths at the side where they meet the coils 20, but then merge into one common path which leads to the terminal supporting member 14 supporting the earthing terminal fitting 30A of the connector member 13. The five leading wires 24 distributed in the earthing wire distribution grooves 15A are wound around the electric wire attachment member 32 of the earthing terminal fitting 30A, and are also unified therewith by fusing, e.g. by ultrasonic welding. A filler 16 such as epoxy resin is injected into all of the wire distribution grooves 15A and 15B, this filler 16 fixing the leading wires 24 within the wire distribution grooves 15A and 15B.

After the coils 20 and the terminal fittings 30 have been attached to the attachment base 10 and the leading wires 24 have been fixed by the filler 16, a cover 40 is attached to the upper face of the attachment base 10 by moulding. This cover 40 covers the coils 20 without leaving any space between the cover 40 and the outer circumference of the coils 20, but leaves the upper flange 22 and the inner circumference of the bobbin 21 exposed. Further, the cover 40 covers the connector member 13 so as to tightly cover the upper faces and outer side faces of the terminal supporting member 14, but leaves the tab members 31 of the terminal fittings 30 exposed. In addition, angular tubular shaped fitting members 41 are formed on the cover so as to surround the tab members 31, upper faces of these fitting members 41 being open. The feeder connector C fits with these fitting members 41. Furthermore, with the exclusion of the coils 20 and the connector member 13, the cover 40 tightly covers the entire upper face of the attachment base 10 including the wire distribution grooves 15A and 15B.

The coil device A of the present embodiment is configured as described above, and the feeder connector C is fitted to the connector member 13 by being attached to the fitting members 41. Once this is done, feeder terminal fittings of the feeder connector C are attached to the terminal fittings 30A and 30B. Electricity is supplied to each coil 20 along the path of a wire harness connector, the interrupted connector, the inner connector, the feeder electric wires W, the feeder connector C, the terminal fittings 30A and 30B and the leading wires 24.

In the embodiment described above, the leading wires 24 of a plurality of coils 20 (five coils) are collected together and attached to one connector member 13. This connector member 13 is fitted to the feeder connector C and, consequently, fewer components are required compared to the case in which each coil 20 is provided with an individual connector member. Further, the leading wire 24 is distributed individually along the independent wire distribution grooves 1 5B and as a result contact with other leading wires 24 is prevented. Moreover, the cover 40 covers the coils 20 and the leading wires 24 thereof. Consequently, foreign objects are prevented from entering from the exterior and interfering with the coils 20 or the leading wires 24. Furthermore, the leading wires 24 are fixed within the wire distribution grooves 15A and 15B by the filler 16, and the cover 40 is attached in a unified manner, by moulding, to the coils 20 and the attachment base 10. Consequently, movement or rattling of the components can be prevented, and water is prevented from entering the space between the components. In addition, the fixing of the leading wires 24 by the filler 16 prevents these leading wires 24 from being broken when the moulding is performed.

Figure 1:
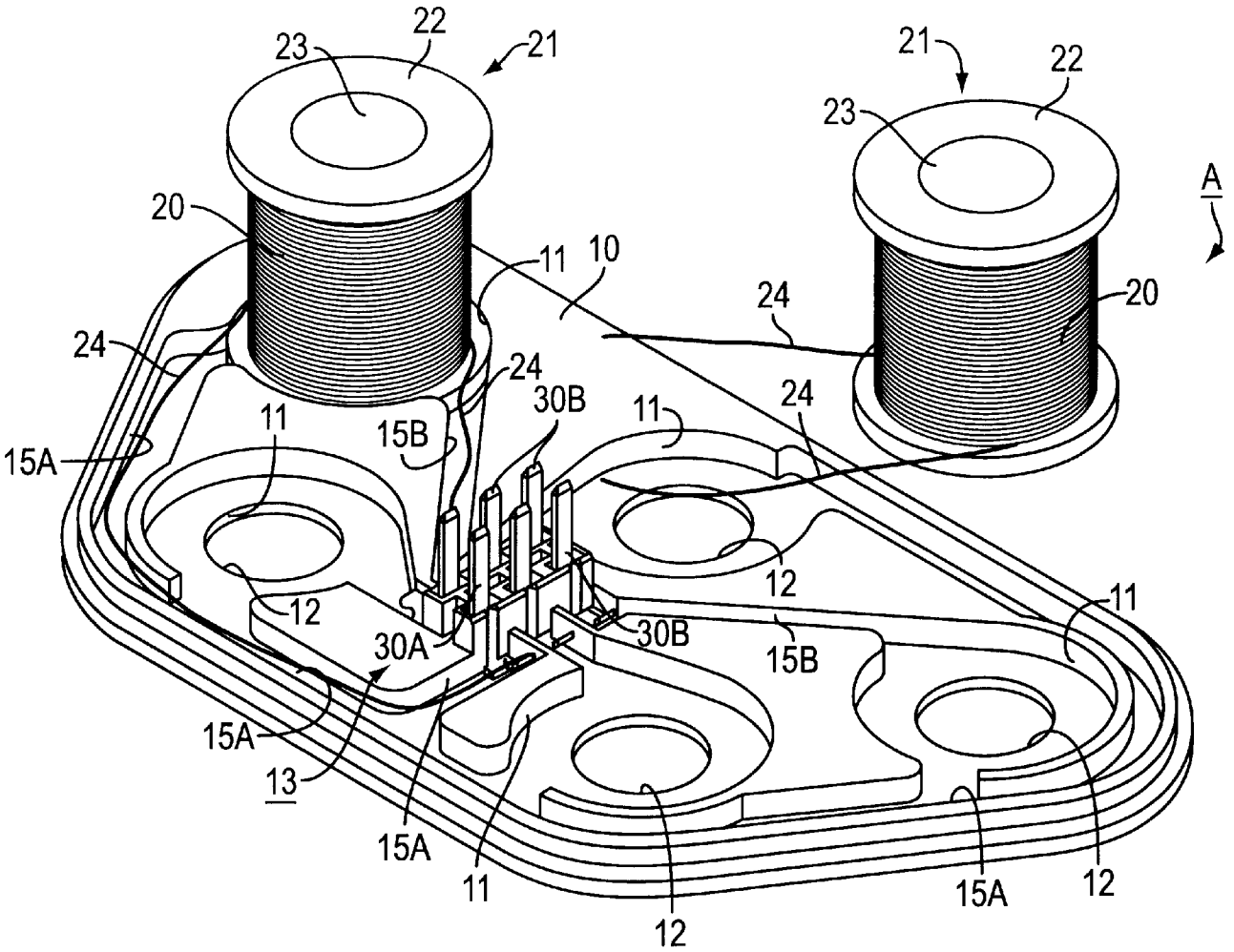
FIG. 1 is a disassembled diagonal view of a first embodiment.
Figure 2:
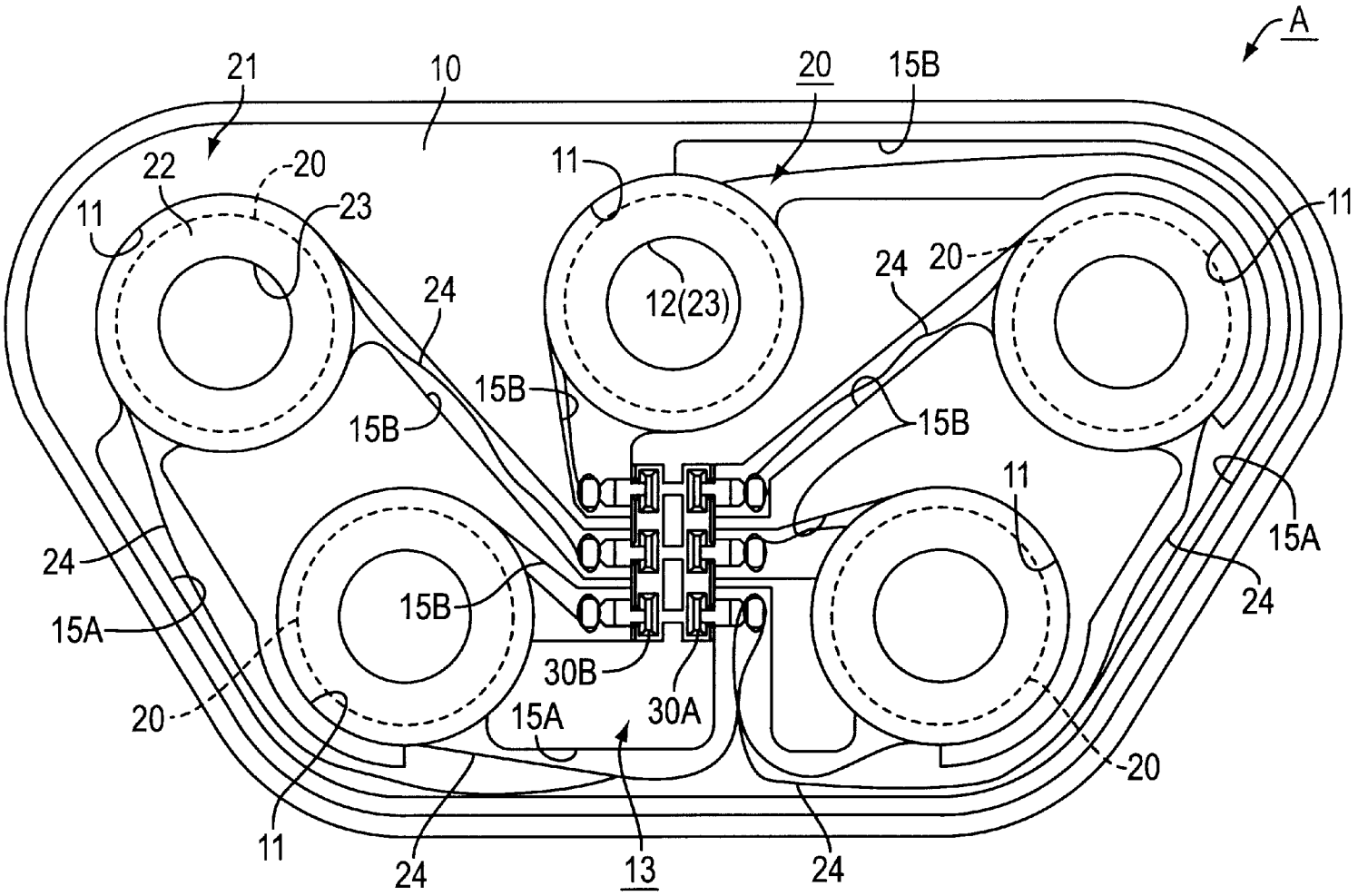
FIG. 2 is a plan view showing a state prior to moulding a covering means.
Figure 3:
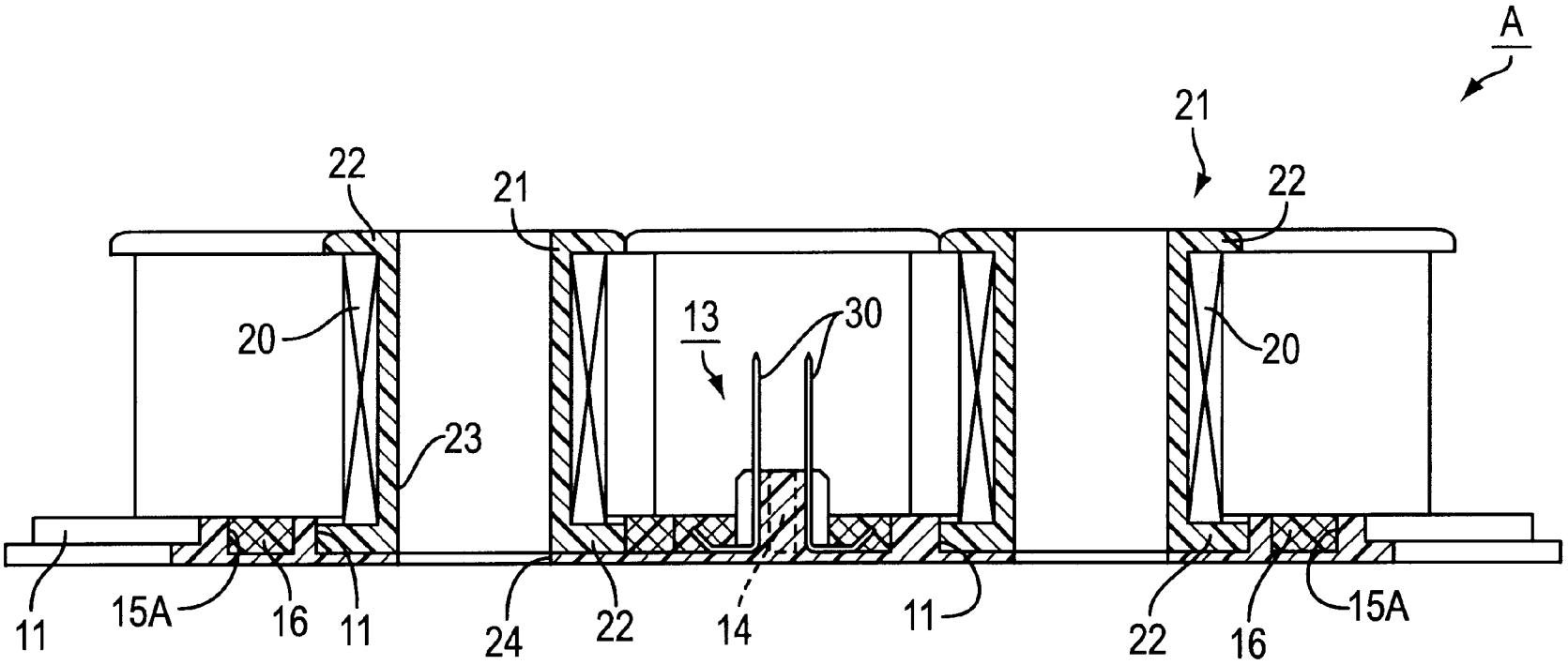
FIG. 3 is a cross-sectional view showing a state prior to moulding.
Figure 4:
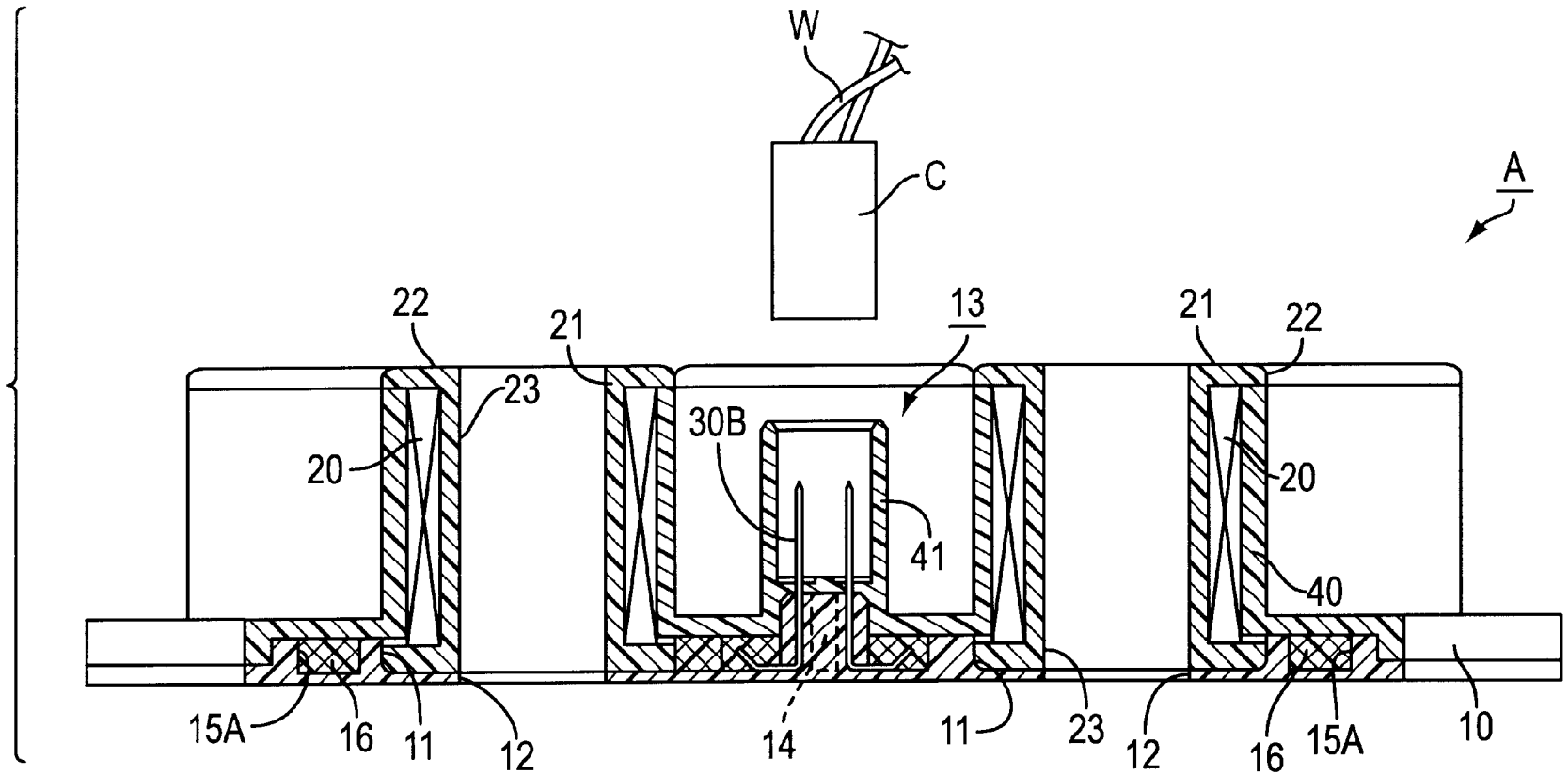
FIG. 4 is a cross-sectional view of an attached state.
Figure 5:
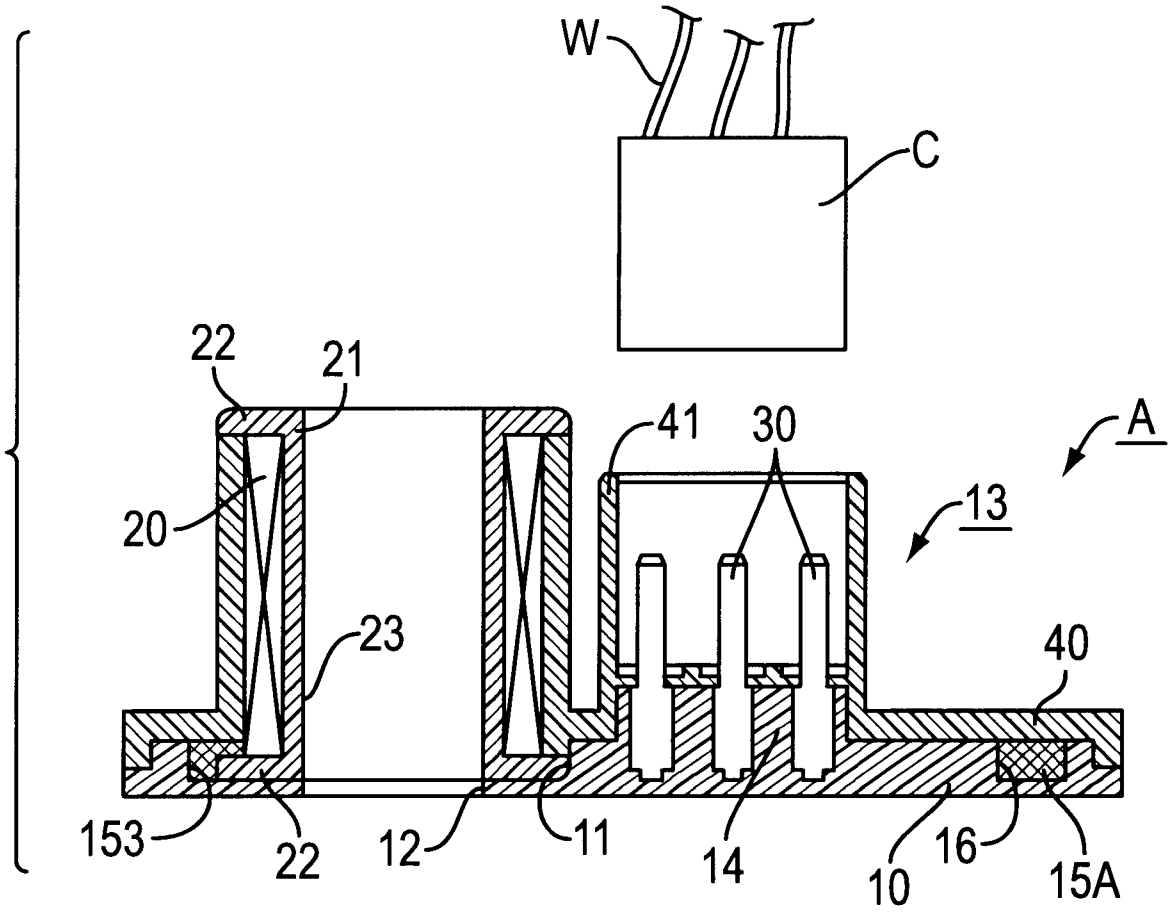
FIG. 5 is a cross-sectional view of an attached state.
Figure 6:
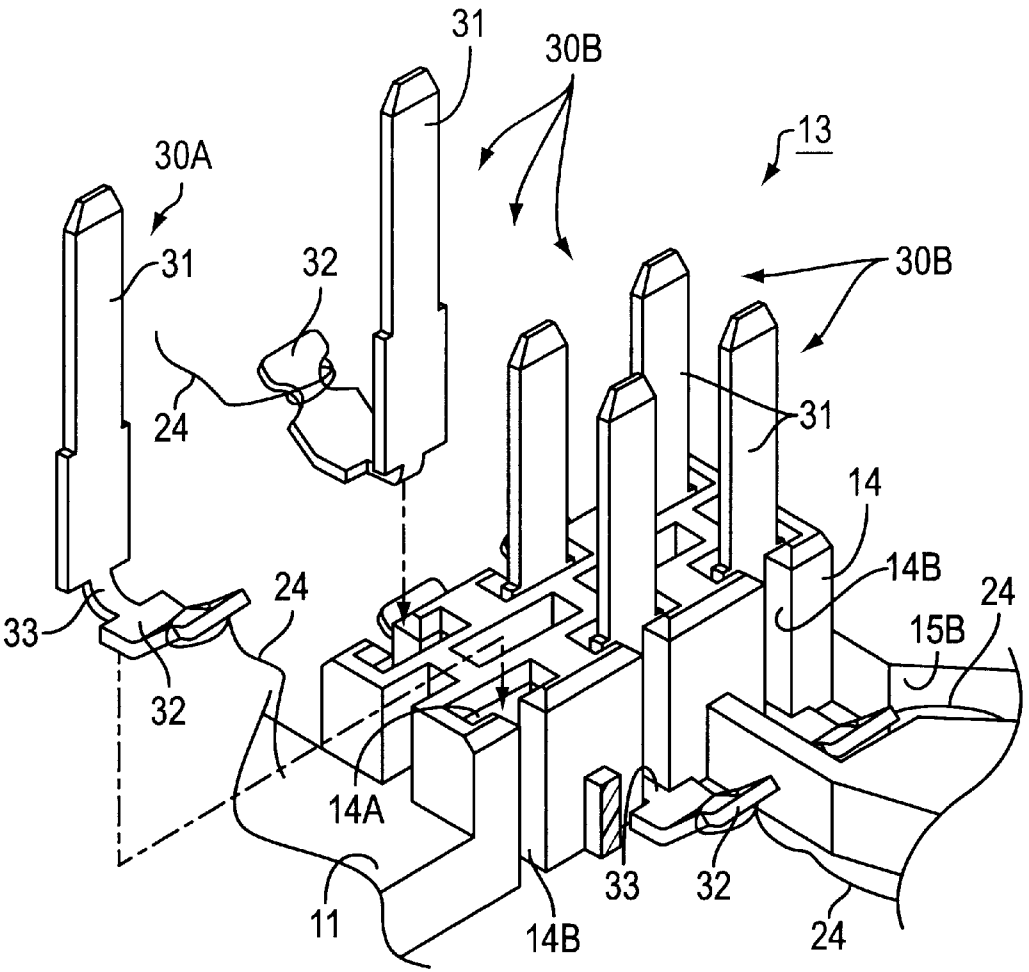
FIG. 6 is a partially expanded diagonal view of a connector member.
Figure 7:
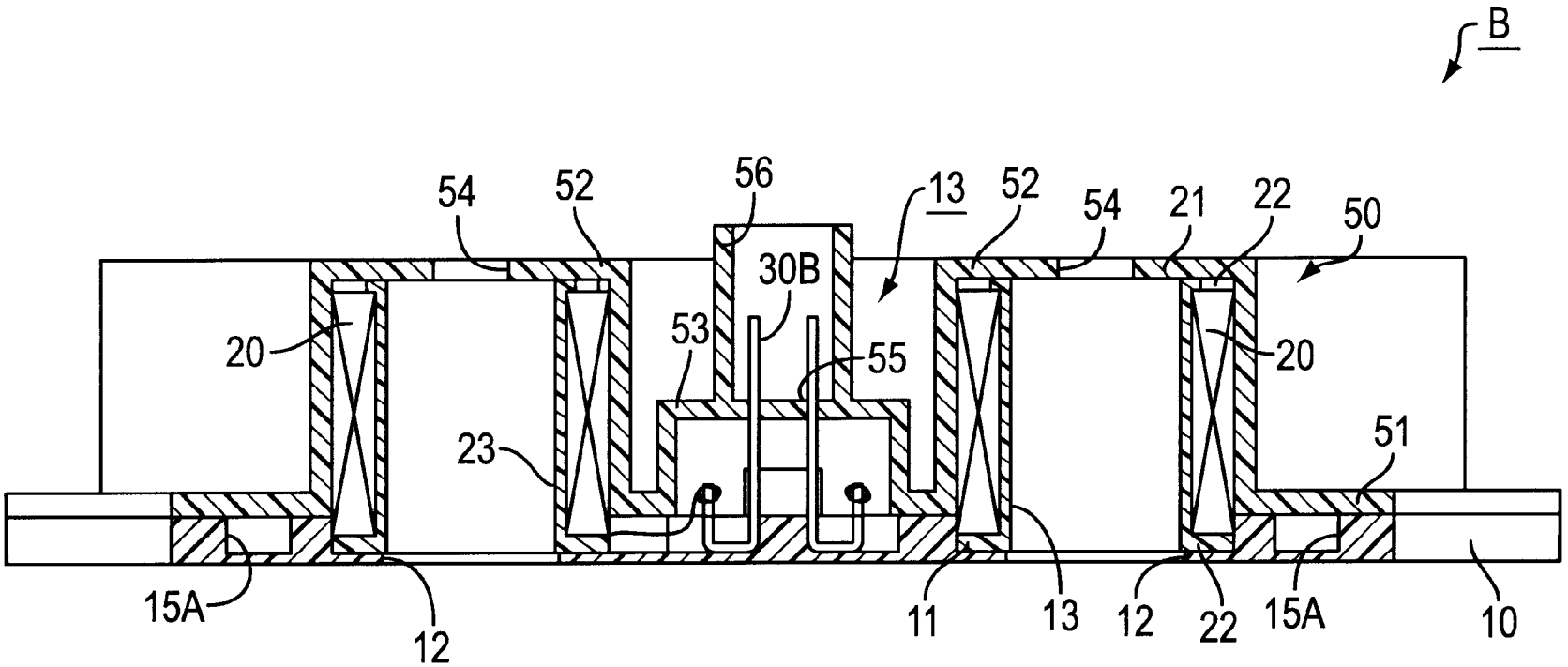
FIG. 7 is a cross-sectional view of an attached state of a second embodiment.
Figure 8:
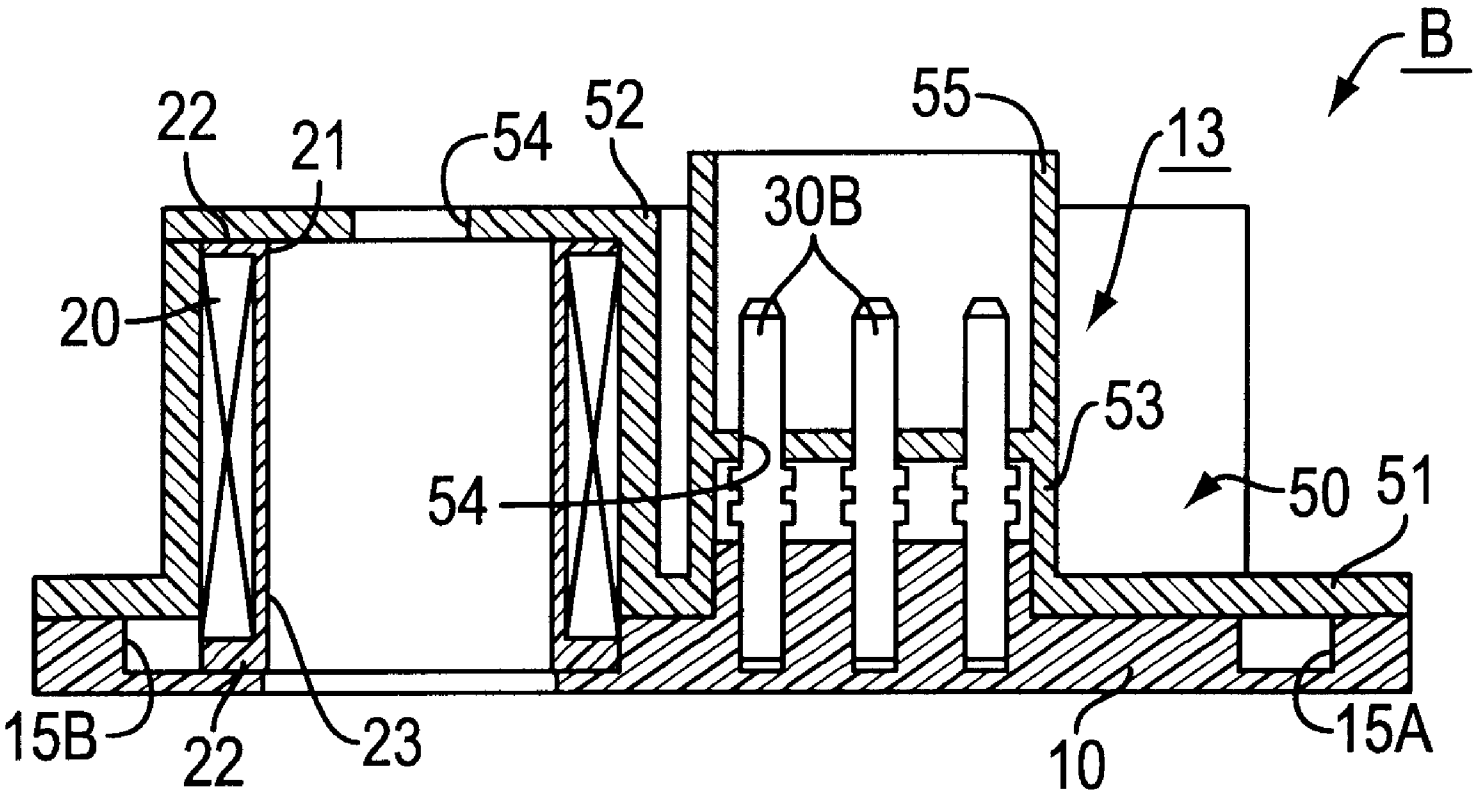
FIG. 8 is a cross-sectional view of an attache d s state of the second embodiment.

A second embodiment of the present invention will be explained with the aid of FIGS. 7 and 8.

The configuration of a coil device B of the present embodiment differs from that of embodiment 1 in that it has a cover 50. Since the configuration of the other parts is the same as in embodiment 1, the same numbers are accorded thereto, and an explanation thereof is omitted.

The cover 50 of this embodiment is produced in a separate process from the attachment base 10, and comprises an adhering member 51, coil covering members 52, and a connector covering member 53. The adhering member 51 is plate-shaped, covers the wire distribution grooves 15A and 15B, and fits tightly with the entire area of the upper face of the attachment base 10, with the exception of the coils 20 and the connector member 13. The coil covering members 52 are round and protrude upwards from the adhering member 51, covering the outer circumference and upper flanges 22 of the coils 20. A through hole 54 having the same size as the core of the bobbin 21 is formed in an upper face of each coil covering member 52. The connector covering member 53 protrudes upwards in a box-shape so as to cover the connector member 13, and tab holes 55 are formed in an upper portion thereof to allow the tab members 31 of the terminal fittings 30A and 30B to fit tightly therein. A connecting member 56, the top thereof being open, is provided on the connector covering member 53. This connecting member 56 surrounds the upper portion of the tab members 31 and fits with the feeder connector C. The adhering member 51 of the plate 50 is fixed in a unified manner to the attachment base 10 by welding or other means. In the second embodiment, the single cover 50 can cover all five coils 20 and, as a result, fewer components and a smaller number of processes are required compared to the case in which each coil 20 is covered separately.

The present invention is not limited to the embodiments described above with the aid of figures. For example, the possibilities described below also lie within the technical range of the present invention. In addition, the present invention may be embodied in various other ways without deviating from the scope thereof.

(1) In the present embodiments, one single covering means covers a plurality of coils. However, according to the present invention, each coil can also be covered individually by a cover, etc.

(2) In the present embodiment, the wire distribution path is a groove shape hollowed into the surface of the attachment base. However, according to the present invention, the wire distribution path may equally well be a set of long and narrow ribs which protrude upwards from the surface of the attachment base and extend from the coils to the connector member, the leading wires being distributed along this set of ribs.

(3) In the present embodiment, earthing leading wires are attached to one terminal fitting as a single unit. However, according to the present invention, the leading wire of each coil may be attached individually to different terminal fittings.

(4) In the present embodiment, the coils are fixed to the coil attachment members by means of adhesive. However, according to the present invention, not only adhesive, but other means may also be used, such as a mechanical supporting means like a locking mechanism which has a resilient stopping member on the attachment base, the coils being engaged and supported by this supporting means.

(5) In the present embodiment, the terminal fittings are supported on the attachment base by terminal supporting members, the terminal fittings being pushed thereon. However, according to the present invention, pushing need not be the only method used. For example, insert moulding may be used to form the terminal fittings in a unified manner with the attachment base, or a resilient stopping means provided on the attachment base may support the terminal fittings in an attached state.

What is claimed is:

1. A connector base for a plurality of coils each having a wire with a coiled segment and a lead segment extending from the coil, the base having a plurality of attachment locations, each attachment location corresponding to a respective coil of the plurality of coils, a connector body formed on the connector base configured to couple to a complementary connector, said connector body having a plurality of terminals housed therein, the terminals being connected to the lead segments of the wires of the plurality of coils, and wire distribution paths provided on the base including a respective wire distribution path for guiding each lead segment extending from one of said coils to the connector body along the base without crossing another distribution path.

2. A connector base according to claim 1 wherein said distribution paths are defined by channels formed in said base.

3. A connector base according to claim 1 wherein said attachment locations are arranged around said connector body.

4. A connector base according to claim 2 wherein said attachment locations are arranged around said connector body.

5. A connector base according to claim 1 wherein said attachment locations are defined by recesses in said base.

6. A connector base according to claim 1 wherein said connector body includes a tubular housing for each of said terminals, each tubular housing having a slot in the wall thereof, and each terminal extending through a respective slot to the interior of a respective housing.

7. A connector base according to claim 6 wherein each of said terminals includes a neck in a mid portion thereof, each neck being located in the slot through which its corresponding terminal extends.

8. A connector assembly comprising a connector base according to claim 1, and a feeder connector for attachment to said terminals.

9. A connector assembly comprising the connector base according to claim 2, further comprising a filler in each channel, wherein a coil of said plurality of coils is located in each of said attachment locations, each coil having a lead wire attached to a respective terminal and each of said lead wires being retained in a channel by the respective filler in that channel.

10. A connector assembly according to claim 9 and further including a cover attached thereto, said cover enclosing said coils and lead wires without obstructing said terminals and axially extending through holes of said coils.

* * * * *